United States Patent [19]

Gnest et al.

[11] 4,381,094

[45] Apr. 26, 1983

[54] APPARATUS FOR DETERMINING THE SIGNAL TERM TO BE TRANSMITTED TO A RAILROAD TRACTION VEHICLE

[75] Inventors: Horst-Guenter Gnest, Lehrte; Wolfgang-Dieter Granzow; Hans-Otto Hartkopf, both of Brunswick; Adalbert Zillmer, Wolfenbuettel, all of Fed. Rep. of Germany

[73] Assignee: Siemens Aktiengesellschaft, Berlin & Munich, Fed. Rep. of Germany

[21] Appl. No.: 223,271

[22] Filed: Jan. 8, 1981

[30] Foreign Application Priority Data

Jan. 16, 1980 [DE] Fed. Rep. of Germany ..... 3001440

[51] Int. Cl.[3] ..... B61L 3/18

[52] U.S. Cl. ..... 246/182 R

[58] Field of Search ..... 246/182 R, 182 C, 182 AA, 246/182 AB, 183, 185, 187 B, 191, 167 R; 364/436; 340/825.22

[56] References Cited

U.S. PATENT DOCUMENTS

| | | | |
|---|---|---|---|
| 2,780,300 | 2/1957 | Beyer | 246/182 R |
| 3,402,289 | 9/1968 | Burke et al. | 246/167 R |
| 3,643,090 | 2/1972 | Malon | 246/182 R |
| 3,908,939 | 9/1975 | Sheffler | 246/182 R |

*Primary Examiner*—Thomas A. Robinson

*Attorney, Agent, or Firm*—Hill, Van Santen, Steadman, Chiara & Simpson

[57] ABSTRACT

The signal term to be transmitted to a railroad traction vehicle is formed in a signaling system in that each element, from a destination element back to a start element has a respective top speed assigned thereto as an identification. The identification is transmitted element-by-element back to the start element and is devalued during relaying thereof when the identification is greater than that prescribed for a travel path element having a lower assigned top speed so that the identification received at the start element indicates the top speed admissible for the route. The admissible top speed is then converted into a corresponding signal term.

4 Claims, 1 Drawing Figure

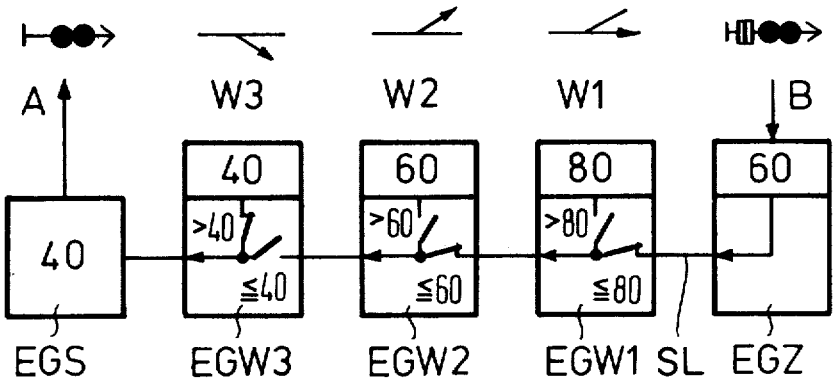
A
W3
W2
W1
B
40
40
>40
≦40
60
>60
≦60
80
>80
≦80
60
EGS
EGW3
EGW2
EGW1
SL
EGZ

APPARATUS FOR DETERMINING THE SIGNAL TERM TO BE TRANSMITTED TO A RAILROAD TRACTION VEHICLE

BACKGROUND OF THE INVENTION

1. Field of the Invention

The present invention relates to a device for determining the signal term to be transmitted to a railroad traction vehicle from the respective, admissible top speeds for the travel path elements lying in the route covered by a signal light or by a, preferably, punctiform train influencing device.

2. Description of the Prior Art

In earlier signaling systems, in which the so-called push-button signaling technique was employed, the signal term to be connected to a signal light was derived from the combination of the respective end destination key actuated for the route position. A specific signal term is allocated to each possible key combination. This method of signal term selection has disadvantages, particularly when an overall route is composed of a plurality of partial routes, as is the case, for example, given train routes over a plurality of signaling zones. Therefore, in more recent track plan push-button signaling technology, one proceeds from the consideration that a signal term to be transmitted to a traction vehicle, apart from special cases, is determined by the switches in the travel path and the length of the braking distance coming into question. The admissible top speed can be selected for each position of every switch and for every braking distance. The velocity values prescribed for the individual route elements of a train path to be set are to be evaluated for determining the signal term to be transmitted to an approaching train according to the rule: the lowest velocity message determines the signal term. In order to derive the lowest velocity message, after a travel route has been determined, the route elements participating in the travel route are induced to emit the velocity message allocated thereto. The various velocity messages are received, examined and evaluated by a central receiving device, the so-called signal selection group. The result of this evaluation, the respectively lowest velocity message, is then forwarded via a closed circuit network to the appertaining signal group of the route start element, which is prepared to receive. The transmission of the signal term determined in such a manner to the approaching train occurs optically by signal light and/or electrically by train influencing elements, which preferably operate on a punctiform basis.

The described operation of signal selection is brief. The central receiving device is occupied for a maximum of 0.5 seconds. Despite this relatively short seizure time, an undesired waiting dependency of a plurality of routes pending for a signal selection can occur, since a random number of routes can simultaneously acquire their velocity term, but the central signal selection group is present only once and is exploited on a time division multiplex basis.

Given a failure of the central signal selection group, the entire signaling system is affected, because none of the signal light or, respectively, the train influencing devices operating in a punctiform manner can be controlled.

SUMMARY OF THE INVENTION

The object of the present invention is to provide a device of the type generally mentioned above which, without a waiting dependency, makes due even given a plurality of routes simultaneously waiting for signal selection, the device leading to an increase of availability in comparison to the known signal selection devices.

The above object is achieved, in a system of the type generally set forth above, in that the respective destination element of the route prescribes a message for its admissible top speed and that the message is relayed step-by-step with reference to the elements from travel path element-to-travel path element back to the start element of the route. The individual travel path elements, given a lower maximum speed assigned thereto, devalue the respectively received message according to the lower speed and forward the identification in devalued form to the next travel path element such that when the message reaches the start element, a corresponding signal term can be determined and transmitted to the direction vehicle.

BRIEF DESCRIPTION OF THE DRAWING

Other objects, features and advantages of the invention, its organization, construction and operation will be best understood from the following detailed description, taken in conjunction with the accompanying drawing, on which there is a single FIGURE which schematically illustrates travel path elements over a given route and illustrates the operation of the apparatus in accordance with the maximum speeds assigned to each travel path element.

DESCRIPTION OF THE PREFERRED EMBODIMENTS

Referring to the drawing, those travel path elements are schematically illustrated which, in setting a route from a signal A to a signal B, participate in the determination of the signal term to be connected to the signal A or to be transmitted to a train by the aforementioned train influencing device. In addition to the destination element, these are the switches W1–W3 lying on the travel path. Different maximum speeds are prescribed for these switches independent of a respective switch position and the radius of curvature of the switches, the maximum speeds being entered in an upper field of the travel path element groups EGW1–EGW3 schematically illustrated below the switch symbols.

A maximum speed admissible for the respectively selected braking distance destination is indicated above the element group EGZ for the destination element of the route. The destination element of the route now connects a message for its admissible maximum speed onto a rail line SL, the travel path elements lying in the travel path being connected via the rail line SL up to the starting element of the route. The message "60" fed in at the destination element arrives at the element group EGW1 of the switch W1 lying in the travel path, if need be by way of further travel path elements (not illustrated) which do not participate in the signal term selection. An admissible maximum speed "80" is prescribed for the switch W1. The message "60" supplied to the element group EGW1 by the route destination element B lies clearly below the maximum speed "80" applying to the route element W1. The received message "60" is therefore connected to the element group EGW2 following in the travel path in terms of the track plan. A maximum speed of "60" is prescribed for the appertaining travel path element. Since the received message is not greater than the message impressed on the element group, the message is forwarded in the direction towards the start element of the route. Thereby, if need be via further element groups not participating in the signal selection, the message arrives at the element group EGW3 of the switch W3. The switch W3 may be traversed with a maximum speed "40". The message "60" supplied to the element group is considerably greater than the message speed admissible for the travel path element W3. The element group EGW3 therefore devalues the received message to the message impressed thereon and forwards the devalued message in the direction towards the start element of the route. The message received by the element group EGS of the start element represents the signal term to be connected or, respectively, to be transmitted to the signal A or, respectively, it is proportional to the signal term to be connected.

The messages connected proceeding from the route destination over the travel path elements incorporated in a route in terms of track plan and, if need be, devalued there, can be represented by means of any desired information. An advantageous embodiment of the invention provides that each message is represented by a specific plurality of pulses, whereby the plurality of pulses per message increases with an increasing magnitude of the appertaining velocity value. By suppressing individual pulses, the transmitted messages can be devalued in the individual element groups to lower values. However, it is also advantageously possible to represent the identifications by means of specific switching times within a time grid, for example, by means of the chronological spacing of two pulses. Thereby, the duration of the switching time is to correspond to the size of the appertaining velocity value, so that, by constricting the switching time, a devaluation of the appertaining velocity is possible. Another, likewise advantageous variation for forming the identification provides that pulse sequences be employed for different velocity values, the pulse sequences being preferably binarily coded and respectively announced by a synchronization pulse; thereby, the respectively more significant pulse message is allocated to the respectively higher velocity value.

A device constructed in accordance with the present invention for determining the signal term to be transmitted to a traction vehicle of a train approaching the start element of a route makes a higher availability attainable in comparison to devices which were heretofore standard, because, in constrast to systems which are standard today, a central device is no longer employed but, rather, the signal term determination occurs decentrally at the individual travel path elements. A potential disruption remains limited to the disrupted travel path element or, respectively, to those routes in which the disrupted travel path element is incorporated.

It is assumed in the exemplary embodiment illustrated on the drawing that the travel path elements to be incorporated in a route are connected to one another via a rail line. However, the employment of the invention does not depend on the existence of such rail lines; what is important, in particular, is only the track plan-wise forwarding of the messages from travel path element-to-travel path element, not the existence of dedicated lines. On the contrary, it is possible that the connection from travel path element-to-travel path element not be completed until a message appears for forwarding. Thereby, the calling of the respectively following travel path element can occur via any desired control lines, for example, via the bus lines of a computer or of a computer system. Therefore, for example, a first computer under whose competency the control and supervision of the travel path elements B and W1 falls, can, after the polling of the message "60" stored for the travel path element B, call the travel path element W1 via the address bus and can poll the message "80" which is valid for the travel path element W1 via the data bus and compare the same to the previously polled message "60". The computer then relays the prevailing message "60" to that computer which is responsible for the control and supervision of the following travel path element or of the following travel path elements W2, W3 and A; this could occur by means of a coded message which contains all data relevant for the further processing of the pending tasks. By way of its address bus, the second computer calls the travel path element W2 and, via its data bus, polls the message stored for the travel path element, compares the message with the received message and makes it available to the following travel path element W3 via the data bus. The travel path elements to be incorporated in the route are called and processed in terms of track plan in such a manner, whereby the message "40" determining the signal term to be optically or electrically transmitted is already determined and need now only be converted into the corresponding signal term.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. Apparatus for determining a signal term, representing the admissible speed, to be transmitted to a railroad traction vehicle which is to travel over a prescribed route which includes a start element, a destination element and at least one intermediate element, the destination and intermediate elements having maximum speeds assigned thereto, comprising:

respective storage means at the destination element and at each intermediate element storing the respective maximum speed;

destination element transmission means for transmitting a message including the assigned maximum speed back along the route to the next intermediate element;

comparison means at each respective intermediate element for comparing its respective assigned maximum speed with the maximum speed of an incoming message and devaluing the message in response to a message maximum speed which is greater than the respective assigned maximum speed;

intermediate element transmission means at each respective intermediate element for relaying the message, devalued as required, towards the start element; and conversion means at the start element for receiving, converting and transmitting the received message as a signal term.

2. The apparatus of claim 1, wherein each of said transmission means comprises:

means for forming a message to include a number of pulses, with the number being greater in respect of increasing speed.

3. The apparatus of claim 1, wherein each of said transmission means comprises:

means operable to form a message on a pulse time basis wherein the time between the pulses represents speed.

4. The apparatus of claim 1, wherein each of said transmission means comprises:

means for forming a message including a synchronization pulse and a plurality of binarily-coded pulses with the more significant pulses related to higher speeds.

* * * * *